US006360371B1

(12) United States Patent
Davey

(10) Patent No.: US 6,360,371 B1
(45) Date of Patent: Mar. 26, 2002

(54) CONVERTIBLE WET WEATHER GARMENT

(76) Inventor: Peter William Davey, 38 Brighton Road, St. Kilda East, VIC 3183 (AU)

( * ) Notice: Subject to any disclaimer, the term of this patent is extended or adjusted under 35 U.S.C. 154(b) by 0 days.

(21) Appl. No.: 09/582,579

(22) PCT Filed: Dec. 11, 1998

(86) PCT No.: PCT/AU98/01028

§ 371 Date: Jun. 28, 2000

§ 102(e) Date: Jun. 28, 2000

(87) PCT Pub. No.: WO99/29197

PCT Pub. Date: Jun. 17, 1999

(30) Foreign Application Priority Data

Dec. 11, 1997 (AU) ..... PP0845

(51) Int. Cl.[7] ..... A41D 3/02
(52) U.S. Cl. ..... 2/86; 2/69; 2/466
(58) Field of Search ..... 2/456, 69, 69.5, 2/70–72, 86, 89, 93–94, 466, 46–48, 51, 108, 211–214, 242, DIG. 5

(56) References Cited

U.S. PATENT DOCUMENTS

| | | | | | |
|---|---|---|---|---|---|
| 1,250,004 | A | * | 12/1917 | Philip | 2/213 |
| 1,648,282 | A | * | 11/1927 | Scheider | 2/86 |
| 1,693,464 | A | * | 11/1928 | Quantz | 2/86 |
| 2,186,918 | A | | 1/1940 | Wolf | |
| 3,389,407 | A | * | 6/1968 | Morrison | 2/84 |
| 4,390,996 | A | | 7/1983 | Read | |
| 4,712,252 | A | | 12/1987 | Chou | |
| 5,101,514 | A | | 4/1992 | Eklund | |
| 5,295,267 | A | | 3/1994 | Gallindo | |
| 5,465,424 | A | * | 11/1995 | Cudney et al. | 2/456 |

FOREIGN PATENT DOCUMENTS

| | | |
|---|---|---|
| CA | 1312997 | 1/1993 |
| DE | 406671 | 4/1924 |
| FR | 498649 | 1/1920 |
| FR | 803051 | 9/1936 |
| JP | 07-331508 A | 12/1995 |

* cited by examiner

*Primary Examiner*—John J. Calvert
*Assistant Examiner*—Tejash Patel
(74) *Attorney, Agent, or Firm*—Finnegan, Henderson, Farabow, Garrett & Dunner, L.L.P.

(57) ABSTRACT

A garment adapted to be converted between a coat and wet-weather gear suitable for use by a person when seated upon a motor-cycle. The garment includes portions to be arranged in a first pattern to form the coat and to be arranged in a second pattern to form the wet-weather gear. One of the portions in the first pattern includes two panels located in use below the waist of the person wearing the garment. The panels are separated by a vent located, in use, to the rear of the garment, oand each of the panels is adapted to be connected together as garment legs about the respective legs of the person. Another of the portions includes a crotch portion attached in the first pattern to the inside rear of the garment, at or below the waist of the person, the crotch portion, in the second pattern, providing protection for the crotch of the person wearing the garment against wet weather when seated. Conversion between the two patterns may be carried out while the person is wearing the garment.

4 Claims, 3 Drawing Sheets

CONVERTIBLE WET WEATHER GARMENT

This invention relates to apparel, and in particular relates to dual-purpose clothing.

Many motorcycle riders find it inconvenient to don wet weather clothing when protection from inclement weather is necessary. Conventional wet weather gear must usually be added to existing clothing, and usually must be unpacked from storage. Such difficulties also apply to the riding of other vehicles such as snowmobiles, and to the riding of animals such as horses. In fact, any situation involving a person being seated in an outdoor location, such as watching a sporting event such as a football match, may result in the aforementioned problems.

U.S. Pat. No. 5,295,267 by Galindo discloses a protective loincloth garment for motorcycle riders, which is intended to depend from a conventional item of apparel such as a pair of trousers, to shield the groin and inner thighs from cold, wind and wet weather while the wearer sits astride a motorcycle. Such a garment may be categorised as a variant of the conventional wet weather gear discussed hereinbefore, and does not address the problems outlined in this introduction.

In U.S. Pat. No. 4,712,252 to Chou et at, there is shown an "anti-wind raincoat" for use in activities such as mountaineering. The coat consists of coat, skirt and sleeve portions, made of wind and rain resistant material. Normally, the skirt and sleeves are rolled up so that the garment functions only as a coat, but to cope with rain, the skirt and sleeves may be rolled down. Such an arrangement does not address the problems encountered by a motorcycle rider in inclement weather.

U.S. Pat. No. 5,101,514 by Heklund discloses a convertible garment adapted to be used by a seated person. However, the aim of the Heklund invention is to provide a "seat pad" which is normally stored within the garment, but which is removable from storage and relocatable to provide a seat for the wearer of the garment when he or she sits on a hard surface such as a tree stump.

The prior art does not address the difficulties discussed in this introduction, and accordingly there is a need for clothing which is able to be worn as a conventional item of clothing, but which is able to be adapted so that it may be used as motorcycle wet weather gear.

It is an object of this invention to provide an improved garment which is adapted to be converted to weather gear suitable for riding or sitting.

The invention provides a garment adapted to be converted between, on the one hand, a coat, and on the other hand, wet-weather gear suitable for use by a person when seated upon a motor-cycle, said garment including portions which when arranged in a first pattern form said coat and when arranged in a second pattern form said wet-weather gear, characterised in that one of said portions is constituted in said first pattern by two panels of said coat, said panels being located in use below the waist of said person wearing said coat, said panels being separated by a vent located, In use, to the rear of said coat, each of said panels being adapted to be connected together about the respective legs of said person, in that another of said portions is a crotch portion which in said first pattern is a flap attached, in use, to the inside rear of said coat at and/or below the waist of said person, and which in said second pattern provides protection for the crotch of the person against wet weather when said person is seated, and in that conversion between said two patterns is carried out while said person is wearing said garment.

An embodiment of the invention, which may be preferred, will be described in detail hereinafter with reference to the accompanying drawings, in which.

Figure 1:
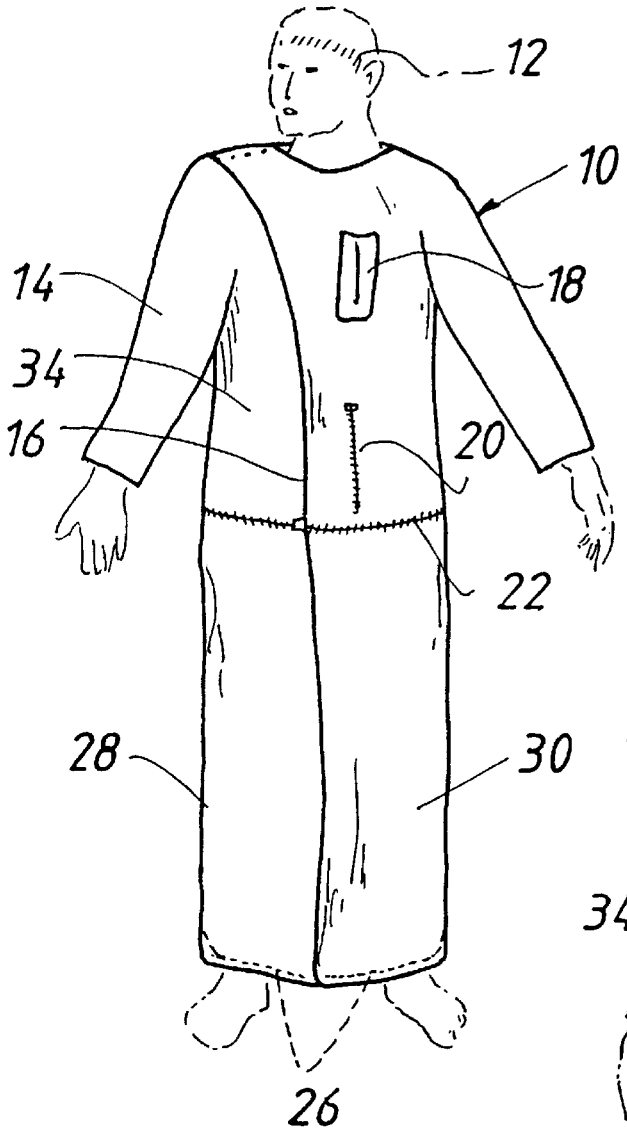
FIG. 1 is a front elevation of an embodiment of a garment in accordance with the present invention.

The garment of FIG. 1 is a long coat, of the type once styled a "maxi coat", but within the parameters of the present invention could be any article of clothing. It may preferably be made of moleskin material, but could of course be made of any suitable material.

It is intended that the coat or alternative garment 10 be a stylish item, but a stylish item which may be used to cope with the exigencies of bad weather, the bane of motorcyclists, in particular.

The coat 10 is shown in each Figure on an outline of the FIG. 12 of a wearer of the garment. In FIG. 1, one can see that the coat has long sleeves 14 (although the sleeves may be any length or may be omitted) and is preferably double-breasted with a curved line 16 indicating where the coat closes. A front pocket 18 may be provided for a cellular (mobile) telephone or the like (not shown), and a zip fastener closed pocket 20 may also be provided. A zip fastener line 22, part of the conversion process, is provided, and for the coat mode is fastened. Reference in this specification to a zip fastener line is a reference to a line of conventional zip fastener tracks. Depending on the context, the line may be a single line of tracks unconnected to another single line by a closure mechanism, or to a double line of interconnected tracks. Of course, other connections means for the various portions of the garment may be used. One alternative mechanism would involve the use of Velcro (Registered Trade Mark) material.

Zip fastener line 22 continues to the rear side (FIG. 2) of coat 10. Zip fastener tracks 24 are also provided on the rear of coat 10; these are adapted to engage in a conventional fashion with tracks 26 on the inner side of the lower portions 28, 30 of the coat 10.

Figure 2:
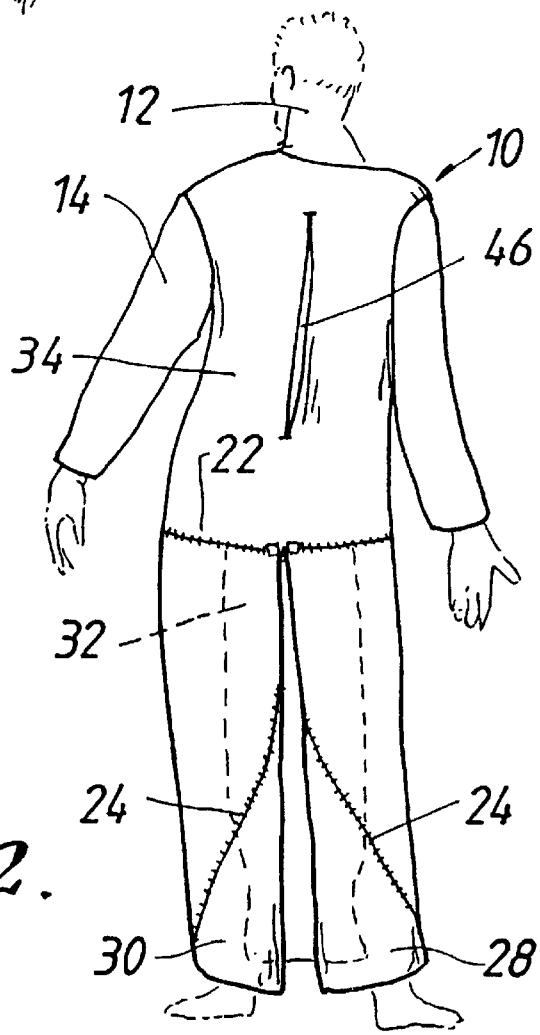
FIG. 2 is a rear elevation of the garment of FIG. 1.
Figure 3:
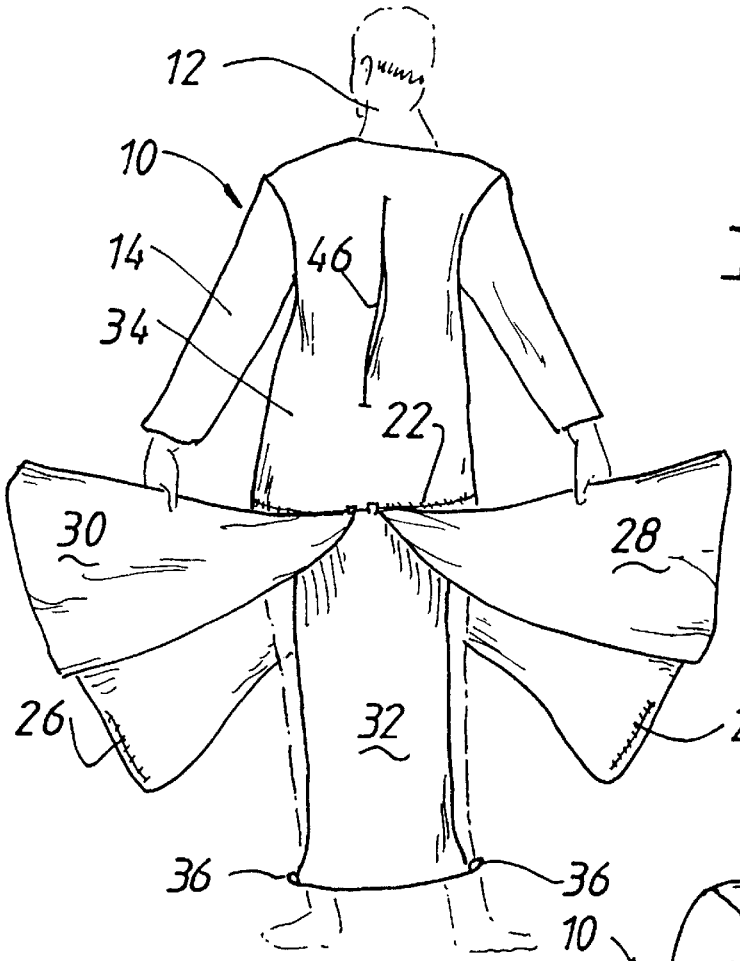
FIG. 3 is a rear elevation, similar to that of FIG. 2, but showing the depending crotch portion.

FIGS. 2 and 3 show the crotch portion 32, in the form of a flap of material, which when the coat 10 is being used in coat mode, is attached to the inside rear of coat 10. Each side of the lower part of portion 32 may have part of fastening means 36 such as those used in luggage, backpacks and the like, where plastics elements are adapted to removably click in to one another.

Figure 4:
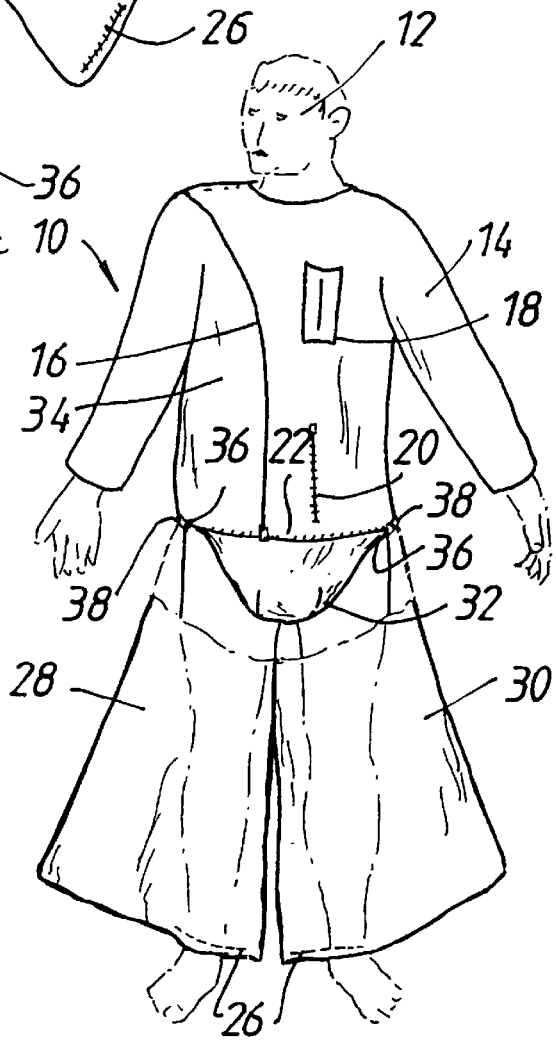
FIG. 4 is a front elevation showing the crotch portion fastened in place.

FIG. 4 shows the first stage of converting the coat 10 to wet-weather gear, with crotch portion 32 drawn up beneath the crotch of the wearer, with fastener portions 36 clicked into respective second fastener portions 38 attached to the inside of coat 10. That arrangement allows the wearer 12 to sit on a motor cycle in wet weather, with the wearer and the wearer's street clothes protected from wetness which may be on the seat of the motor cycle or which may enter the seat area.

In order that a wearer 12 may comfortably sit on a motor cycle seat, one opens the zip fastener 22, behind which is a larger flap of material 40, which allows a person to bend and sit, because the extra material 40 caters for such movement However, the flap of material 40 is also important in the conversion of coat or the like 10, as will be noted from the following description.

Figure 5:
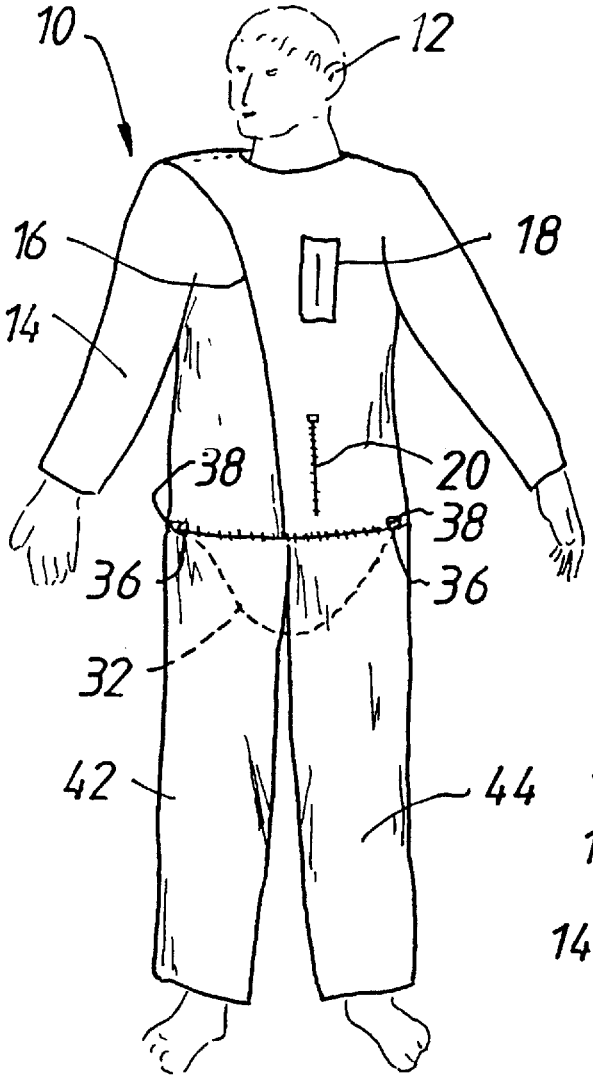
FIG. 5 is a front elevation showing the garment of FIG. 1 converted to wet-weather gear.

In FIG. 5, the coat 10 is shown in "wet-weather gear" mode, with zips 24, 26 fastened to create, while the wearer

12 is wearing the garment, trouser legs 42, 44. Flap 40 is also used to form the trouser legs 42, 44.

Figure 6:
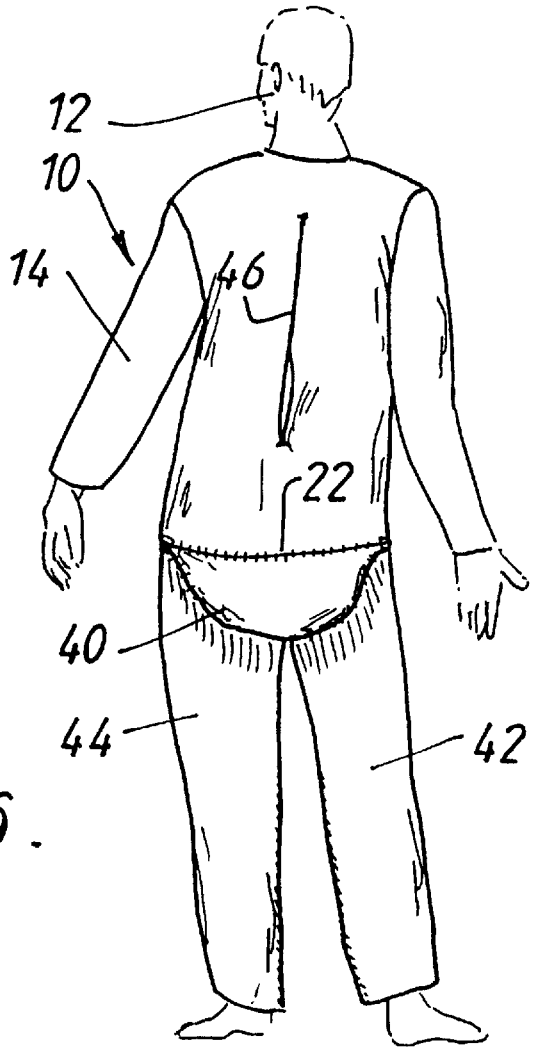
FIG. 6 is a rear elevation of the garment of FIG. 5.

Thus, in FIGS. 5 and 6, there is shown the final form of the "wet-weather gear" mode, with the crotch portion 32 in place, with the expansion created by material piece 40, and with legs 42, 44 created. A person, without having removed the garment 10, has been easily able to convert the coat 10 into a garment suitable for wet-weather use, in particular, to enable a motor cycle to be ridden in inclement weather.

It can be seen that the present invention provides an elegant item of apparel, which readily converts while it is being worn to wet-weather gear.

The entire contents of the specification, claims and drawings of Australian Provisional Patent application No. PP0845 filed on Dec. 11, 1997 are hereby incorporated into this description. The claims form part of the description of this application.

What is claimed is:

1. A garment adapted to be converted between a coat and wet-weather gear suitable for use by a person when seated upon a motor-cycle, the garment comprising:

portions to be arranged in a first pattern to form the coat and to be arranged in a second pattern to form the wet-weather gear, one of said portions in said first pattern including two panels located in use below the waist of the person wearing the garment, said panels being separated by a vent located, in use, to the rear of the garment, each of said panels being adapted to be connected together as garment legs about the respective legs of the person, another of said portions comprising a crotch portion attached in said first pattern to the inside rear of the garment, at or below the waist of the person, said crotch portion, in said second pattern, providing protection for the crotch of the person wearing the garment against wet weather when seated, and wherein conversion between said two patterns may be carried out while the person is wearing said garment.

2. A garment according to claim 1, including a further one of said portions located, in use, at the rear of the garment, and wherein conversion from the coat to the wet-weather gear includes opening up of the further one of said portions, said further one of said portions allowing the person wearing the garment extra movement within the garment as necessary when the wearer is seated on a motorcycle, said further one of said portions also being adapted to assist in the formation of said garment legs.

3. A garment according to claim 2, wherein said further one of said portions includes additional material located within a recess in which said first pattern is closed, said recess being open in said second pattern.

4. A garment according to any preceding claim, including zip fastener tracks on at least some of said portions to facilitate the conversion of the garment between the coat and the wet-weather gear.

* * * * *